US009539822B2

(12) United States Patent
Bhattacharyya et al.

(10) Patent No.: US 9,539,822 B2
(45) Date of Patent: Jan. 10, 2017

(54) DIGITAL PRINTERS

(75) Inventors: Manoj K Bhattacharyya, Palo Alto, CA (US); Hou T Ng, Cambell, CA (US); Laurie S Mittelstadt, Belmont, CA (US); Wenjia Zhang, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/371,336

(22) PCT Filed: Jan. 13, 2012

(86) PCT No.: PCT/US2012/021222

§ 371 (c)(1),
(2), (4) Date: Jul. 9, 2014

(87) PCT Pub. No.: WO2013/105970

PCT Pub. Date: Jul. 18, 2013

(65) Prior Publication Data

US 2015/0015655 A1 Jan. 15, 2015

(51) Int. Cl.
*G03G 9/13* (2006.01)
*G03G 9/125* (2006.01)
(Continued)

(52) U.S. Cl.
CPC ..... *B41J 11/0015* (2013.01); *B41J 2/01* (2013.01); *G03G 9/125* (2013.01); *G03G 9/132* (2013.01);
(Continued)

(58) Field of Classification Search
CPC .... G03G 15/10; G03G 15/6585; G03G 9/132; G03G 9/125; G03G 10/6585; B41J 11/0015; B41J 2/01
See application file for complete search history.

(56) References Cited

U.S. PATENT DOCUMENTS 3,072,521 A 1/1963 Samuelson
5,259,969 A 11/1993 Srivatsa
(Continued)

FOREIGN PATENT DOCUMENTS

JP 2000214623 A 8/2000
JP 2001026096 1/2001
(Continued)

OTHER PUBLICATIONS

Majnaric, I., "The Influence of Electroink Pigmentation on the Quality of Indirect Digital Printing", (Research Paper), 11th International Conference on Printing, Design and Graphic Communications, Sep. 26-29, 2007, Zadar, Croatia, pp. 85-89.
(Continued)

*Primary Examiner* — Sarah Al Hashimi
(74) *Attorney, Agent, or Firm* — Dierker & Kavanaugh, P.C.

(57) ABSTRACT

A digital printing system includes components to apply an ink layer on a substrate, and a deinking applicator. The deinking applicator includes a reservoir and a roller. The reservoir is to contain a deinking solution. The roller is positioned to receive the deinking solution from the reservoir and to coat the substrate with the deinking solution prior to the application of the ink layer or subsequent to the application of the ink layer.

20 Claims, 3 Drawing Sheets

(51) Int. Cl.

| | |
|---|---|
| ***G03G 15/00*** | (2006.01) |
| ***G03G 15/10*** | (2006.01) |
| ***B41J 11/00*** | (2006.01) |
| ***B41J 2/01*** | (2006.01) |
| *B41M 7/00* | (2006.01) |
| *G03G 21/00* | (2006.01) |
| *B41M 5/00* | (2006.01) |

(52) U.S. Cl.

CPC ..... *G03G 15/10* (2013.01); *G03G 15/6585* (2013.01); *B41M 5/0011* (2013.01); *B41M 7/00* (2013.01); *B41M 7/0009* (2013.01); *G03G 21/00* (2013.01); *G03G 2215/00801* (2013.01)

(56) References Cited

U.S. PATENT DOCUMENTS

| | | | | |
|---|---|---|---|---|
| 5,302,242 | A | 4/1994 | Richmann | |
| 5,304,316 | A | 4/1994 | Urushibata | |
| 5,403,440 | A | 4/1995 | Daute | |
| 5,463,447 | A | 10/1995 | Kurotori et al. | |
| 5,505,817 | A | 4/1996 | Rodriguez | |
| 5,528,788 | A | 6/1996 | Yamamoto et al. | |
| 5,632,857 | A | 5/1997 | Larson | |
| 5,660,684 | A | 8/1997 | Li | |
| 5,837,098 | A | 11/1998 | Li | |
| 5,970,272 | A * | 10/1999 | Kobayashi et al. | 399/1 |
| 6,022,423 | A | 2/2000 | Bhatia | |
| 6,277,208 | B1 | 8/2001 | Sano et al. | |
| 6,832,055 | B2 * | 12/2004 | Ochiai | B41J 11/0015 134/122 R |
| 8,337,978 | B2 | 12/2012 | Bhattacharyya | |
| 2004/0129298 | A1 * | 7/2004 | Sarda et al. | 134/32 |
| 2005/0115586 | A1 | 6/2005 | Sarda | |
| 2007/0228005 | A1 | 10/2007 | Hasegawa | |
| 2010/0251916 | A1 | 10/2010 | Peles | |
| 2011/0104409 | A1 * | 5/2011 | Mittelstadt | B41M 5/506 428/32.21 |
| 2011/0108221 | A1 | 5/2011 | Cotter | |
| 2011/0170909 | A1 * | 7/2011 | Garcia | G03G 15/10 399/239 |
| 2012/0103542 | A1 | 5/2012 | Ng | |
| 2012/0206533 | A1 | 8/2012 | Ng | |

FOREIGN PATENT DOCUMENTS

| | | |
|---|---|---|
| JP | 2010100985 | 5/2010 |
| JP | 2011102450 | 5/2011 |
| WO | 2011058935 | 5/2011 |

OTHER PUBLICATIONS

International Search Report and the Written Opinion PCT/US2012/021222 dated Sep. 24, 2012, 8 pp.

Office Action for related U.S. Appl. No. 13/194,066 dated Jun. 20, 2013, 15 pp.

European Search Report, issued Feb. 9, 2015; in related EP application 185460.5.

* cited by examiner

DIGITAL PRINTERS

BACKGROUND

The present disclosure relates to digital printers.

The global print market is in the process of transforming from analog printing to digital printing. Inkjet printing and electrophotographic printing are examples of digital printing techniques. Similar to analog-generated prints, it may be desirable to recycle digitally-generated prints. Some current recycling processes involve a deinking method, where ink is removed from waste paper pulp. In some cases, the deinking method includes applying deinking chemicals to waste paper, which interact with and remove the inked portions of the waste paper.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Processes for recycling printed waste papers, in some instances, involve converting the waste paper into a pulp, while contacting the pulp with deinking chemicals. The deinking chemicals interact with the ink, and then separate the ink from the waste paper. This recycling process has suitably been used for waste papers printed using offset inks, but some challenges may exist for separating and removing digital inks (e.g., LEP, digital inkjet, or other digitally printed inks) from waste papers. For instance, traditional deinking involves removing ink particulates falling within a size range of about 10 microns to about 100 microns. Some challenges with removing digital ink, particularly digital pigment-based inks or digital dye-based inks, include finding a solution to aggregate the pigment particles or the dye molecules into a desired size range, and changing the particles/molecules physical properties from being too hydrophilic to more hydrophobic. It has been found that some existing deinking chemicals do not, in some instances, efficiently separate the ink from fibers of a waste paper. This may occur, for example, when trying to deink waste papers with large amounts of ink coverage. It is believed that the challenge(s) is/are due, at least in part, to the material composition and/or properties of the digital ink, which may, in some instances, adversely interact, or not at all, with the deinking chemicals used by the recycling mill. In many cases, the digital ink cannot be separated and removed from the waste paper to an extent required for adequate waste paper recycling.

Without being bound to any theory, it is believed that digital inks may suitably be separated from waste papers by including a deinking solution on the paper either before or after ink is applied to the paper to form a digitally printed image. This deinking solution may be applied using any of the digital printing systems disclosed herein, which include a deinking applicator designed to apply the deinking solution in a selective and desired manner. Examples of the deinking applicator enable a deinking layer to be formed that has an effective thickness ranging from about 10 nm to about 500 nm. The addition of the deinking layer does not deleteriously affect the look or feel of the print (e.g., substrate curling is not induced), and advantageously renders the print deinkable. It is believed that during a deinking process, the deinking layer helps the ink to break up into smaller particles or to make the particles floatable during flotation. As such, the deinking solution applied using the applicators disclosed herein renders the ink deinkable using, for example, conventional alkaline deinking processes that utilize a combination of NaOH, $Na_2SiO_3$ and oleic acid.

Figure 1:
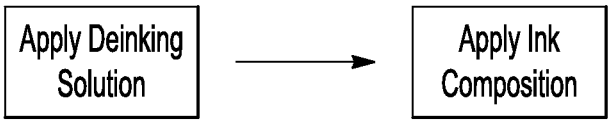
FIG. 1 is a flow diagram depicting an example of a method for generating a deinkable print.
Figure 2:
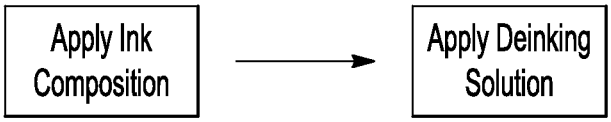
FIG. 2 is a flow diagram depicting another example of a method for generating a deinkable print.

The digital printing systems disclosed herein include components to apply an ink layer on a substrate, and a deinking applicator to apply a deinking solution on the substrate. FIGS. 1 and 2 illustrate two examples of the method for applying the ink layer and the deinking solution. In the example depicted in FIG. 1, the deinking solution is applied to the substrate to form a deinking layer, and then the ink composition is applied on the deinking layer to form a digitally printed image. In FIG. 2, the ink composition is applied to the substrate to form a digitally printed image, and then the deinking solution is applied on the digitally printed image to form the deinking layer. Each of these examples of the method will be further described in reference to FIGS. 3 through 7, which illustrate examples of the digital printing systems.

The deinking solution used in the examples of the LEP systems disclosed herein (see FIGS. 3 and 4) includes a non-polar carrier fluid and a deinking agent. In an example, the deinking solution used in the LEP systems is an emulsion. The deinking solution used in the examples of the inkjet systems disclosed herein (see FIGS. 5 through 7) include water or a solvent and a deinking agent.

The non-polar carrier fluid makes up the bulk of the LEP deinking solution. As such, the amount of non-polar carrier fluid used depends upon the amount of deinking agent used, and in some instances, the amount of other additives used. In some examples when the deinking agent alone is used (i.e., no other additives), the LEP deinking solution may include the non-polar carrier fluid in an amount ranging from about 80 wt % to about 99.8 wt % of a total weight of the substrate 24. In other examples when the deinking agent alone is used (i.e., no other additives), the LEP deinking solution may include the non-polar carrier fluid in an amount ranging from about 70 wt % to about 99.8 wt % of a total weight of the deinking solution.

Examples of suitable non-polar carrier fluid include hydrocarbons, halogenated hydrocarbons, or functionalized hydrocarbons (where functionalization can be accomplished using esters, ethers, sulfonic acids, sulfonic acid esters, and the like). The hydrocarbon may be an aliphatic hydrocarbon, an isomerized aliphatic hydrocarbon, a branched chain aliphatic hydrocarbon, an aromatic hydrocarbon, or combinations thereof. In some examples, the non-polar carrier fluid includes isoparaffinic compounds, paraffinic compounds, dearomatized hydrocarbon compounds, and the like. Specific examples of suitable non-polar carrier fluids include Isopar-G™, Isopar-15 H™, Isopar-L™, Isopar-M™, Isopar-K™, Isopar-V™, Norpar 12®, Norpar 13®, Norpar 15®, Exxsol D40™, Exxsol D80™, Exxsol D100™, Exxsol D130™, and Exxsol D140™ (available from Exxon Mobil Corp.); Teclen N-16™, Teclen N-20™, Teclen N-22™, Nisseki Naphthesol L™, Nisseki Naphthesol M™, Nisseki Naphthesol H™, Solvent L™, Solvent M™, Solvent H™, Nisseki Isosol 300™, Nisseki Isosol 400™, AF-4™, AF-5™, AF-6™ and AF-7™ (available from Nippon Oil Corp.); IP Solvent 1620™ and IP Solvent 2028™ (available from Idemitsu Kosan); and Electron™, Positron ™, and New II™ (available from Ecolink).

The deinking agent may be a non-ionic surfactant; an unsaturated fatty acid having from 19 to 23 carbon atoms; or combinations of unsaturated fatty acids having from 19 to 23 carbon atoms. The deinking agent may be present in an amount ranging from about 0.2 wt % to about 20 wt % of the total weight of the substrate 24. In some examples, the non-ionic surfactant may be present in an amount ranging from about 0.2 wt % to about 5 wt % of the total weight of the substrate 24.

Unsaturated fatty acids having from 19 to 23 carbon atoms or combinations of these unsaturated fatty acids may be used as the deinking agent in the deinking solution that is applied to the substrate 24. Examples of such unsaturated fatty acids include 18-nonadecenoic acid, arachidonic acid, eicosapentaenoic acid, docosahexaenoic acid, erucic acid, and docos-21-enoic acid. When the unsaturated fatty acid has the chemical formula of $C_{22}H_{42}O_2$, it is believed that the double bond may be present at any position along the carbon chain. For example, the $C_{22}H_{42}O_2$ acid may be erucic acid or docos-21-enoic acid.

When a non-ionic surfactant is selected as the deinking agent, the non-ionic surfactant may be an emulsifier. The non-ionic surfactant deinking agent may be chosen from polyoxyethylene (12) isooctylphenyl ether ($(C_2H_4O)_n.C_{14}H_{22}O$ where n~12.5, commercially available as, for example, IGEPAL® CA-720); polyoxyethylene (12) nonylphenyl ether ($(C_2H_4O)_n.C_{15}H_{24}O$ where n=10.5–12, commercially available as, for example, IGEPAL® CO-720); polyoxyethylene (2) cetyl ether ($C_{16}H_{33}(OCH_2CH_2)_2OH$, commercially available as, for example, BRIJ® 52); polyoxyethylene (10) oleoyl ether ($C_{18}H_{35}(OCH_2CH_2)_{10}OH$, commercially available as, for example, BRIJ® 97); polyoxyethylene (20) oleyl ether ($C_{18}H_{35}(OCH_2CH_2)_{20}OH$, commercially available as, for example, BRIJ® 98); polyoxyethylene (100) stearyl ether ($C_{18}H_{37}(OCH_2CH_2)_{100}$ OH, commercially available as, for example, BRIJ® 700); poly (ethylene glycol) dodecyl ether ($C_{12}H_{25}(OCH_2CH_2)_4OH$, commercially available as, for example, BRIJ® 30); poly (ethylene glycol) (150) distearate ($H_{35}C_{17}CO(OCH_2CH_2)_nOOCC_{17}H_{35}$); poly(ethylene glycol) (12) tridecyl ether (mixture of $C_{11}$ to $C_{14}$ iso-alkyl ethers with $C_{13}$ iso-alkyl predominating); poly(ethylene glycol) (18) tridecyl ether (mixture of $C_{11}$ to $C_{14}$ iso-alkyl ethers with $C_{13}$ iso-alkyl predominating); methoxy poly(ethylene glycol) 350 ($H_3C(OCH_2CH_2)_{12}OH$); polyethylene-block-poly(ethylene glycol) with a number average molecular weight (Mn) ranging from 500 to 2500; a monostearate having the formula $CH_3(CH_2)_{16}COO(CH_2CH_2O)_nH$, where n=1–16; a monopalmitate having the formula $CH_3(CH_2)_{14}COO(CH_2CH_2O)_nH$, where n=2–17; a distearate having the formula $CH_3(CH_2)_{16}COO(CH_2CH_2O)_nOC(CH_2)_{16}CH_3$, where n=5–13; a dipalmitate having the formula $$CH_3(CH_2)_{14}COO(CH_2CH_2O)_nOC(CH_2)_{14}CH_3,$$

where n=2–13; a mixed diester having the formula $CH_3(CH_2)_{14}COO(CH_2CH_2O)_nOC(CH_2)_{16}CH_3$, where n=2–14; and mixtures thereof. In an example, the non-ionic surfactant has the formula $CH_3(CH_2)_{16}COOOH_2(CH_2CH_2O)_8H$. An example of this non-ionic surfactant is commercially available under the tradename MYRJ® 45 (a poly oxyethylene (8) stearate) emulsifier, also known as MYRJ® S8, which is a multi-component non-ionic surfactant with monostearate, monopalmitate, and their diesters as the major constituents).

In an example, the LEP deinking solution may be made up of the non-polar carrier fluid and the deinking agent, without any other components being added thereto. In another example, the LEP deinking solution may include other additives, such as those used to control hydrophobic properties of the printed image, those used to control wetting properties of the printed image, or those used to enhance the gloss of the printed image. Any desirable amount of each of these additives may be used, and in an example, any of the additives may be present in an amount ranging from about 0.1 wt % to about 1 wt %. Suitable hydrophobic additives are capable of increasing the hydrophobicity of the ink. Some examples of hydrophobic additives include silicone (e.g., D4, D5), polyisobutylene succinimide, or copolymers of ethylene methacrylate which are soluble in the selected non-polar carrier fluid of the deinking agent. Suitable wetting additives are able to increase the wetting properties of the ink. An example of the wetting additive is soy lecithin. Gloss enhancing additives may include gloss enhancing nanoparticles, such as calcium carbonate, kaolinite, or optical brightening agents.

The liquid used as the bulk of the inkjet deinking solution is either water and/or a solvent, the selection of which depends, at least in part, on the type of inkjet technology being used. For example, water may be more desirable for a deinking solution used in a thermal inkjet printer, and glycol ethers may be more desirable for a deinking solution used in a piezo inkjet printer. The amount of liquid used in the inkjet deinking solution depends upon the amount of deinking agent used, and in some instances, the amount of other additives used. In some examples when the deinking agent alone is used (i.e., no other additives), the inkjet deinking solution may include the liquid in an amount ranging from about 80 wt % to about 99.8 wt % of a total weight of the substrate 24. In other examples when the deinking agent alone is used (i.e., no other additives), the inkjet deinking solution may include the liquid in an amount ranging from about 70 wt % to about 99.8 wt % of a total weight of the deinking solution.

As mentioned above, a deinking solution used in a thermal inkjet printer may be water based. In some instances, the deinking solution may also include (i.e., in addition to water)

co-solvents, such as alcohol and glycols, fixative agents, surfactants, resins, biocides, and combinations thereof.

The deinking agent in the inkjet deinking solution may be selected from those deinking previously set forth for the LEP deinking solution, namely non-ionic surfactants; unsaturated fatty acids having from 19 to 23 carbon atoms; or combinations of unsaturated fatty acids having from 19 to 23 carbon atoms. The deinking agent may be present in the inkjet deinking solution in similar amounts ranging from about 0.2 wt % to about 20 wt % of the total weight of the substrate 24.

In an example, the inkjet deinking solution may be made up of the liquid and the deinking agent, without any other components being added thereto. In another example, the inkjet deinking solution may include other additives, such as those used to control hydrophobic properties of the printed image, those used to control wetting properties of the printed image, or those used to enhance the gloss of the printed image, all of which are described hereinabove.

Figure 3:
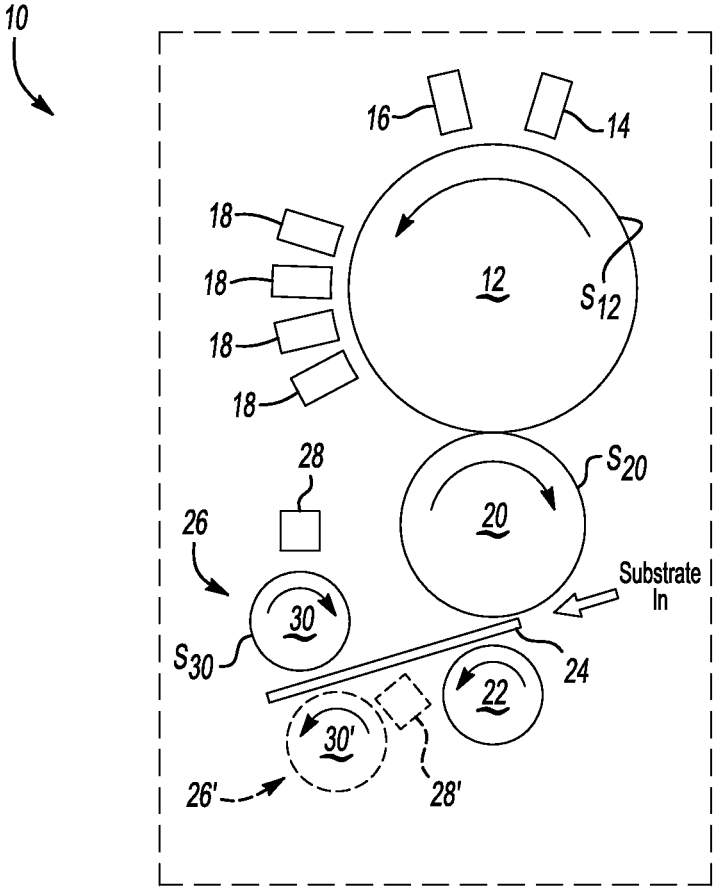
FIG. 3 is a schematic diagram of an example of a liquid electrophotographic (LEP) printing system including an example of a post-treatment deinking applicator.
Figure 4:
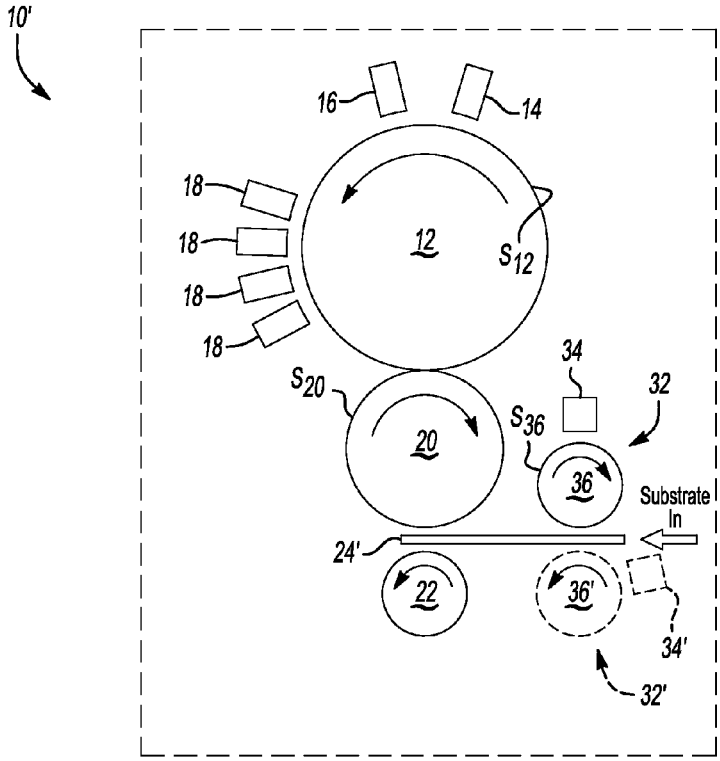
FIG. 4 is a schematic diagram of an example of a LEP system including an example of a pre-treatment deinking applicator.
Figure 5:
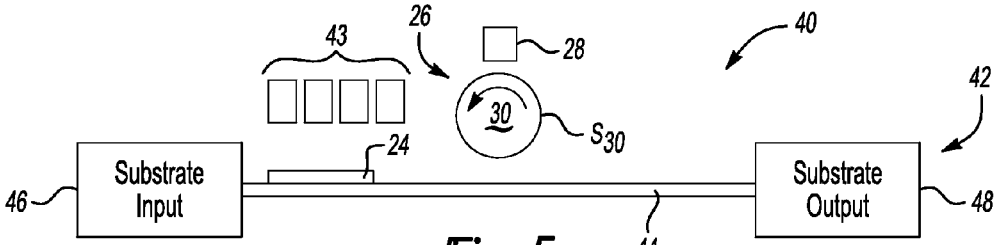
FIG. 5 is a schematic diagram of an example of an inkjet printing system including an example of a post-treatment deinking applicator.
Figure 6:
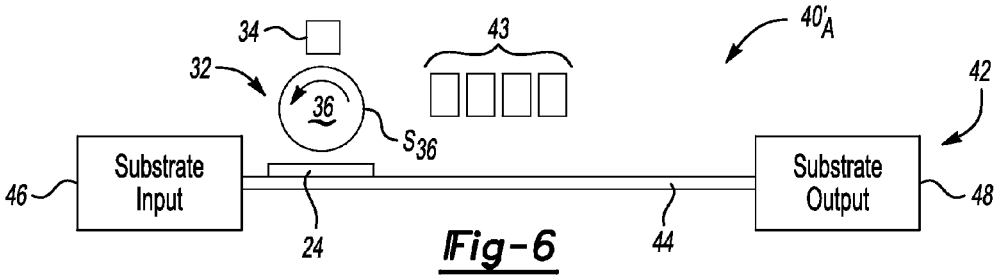
FIG. 6 is a schematic diagram of an example of an inkjet printing system including an example of a pre-treatment deinking applicator.

It is also desirable that the LEP or inkjet deinking solution be substantially transparent so that the applied ink can be seen through the applied deinking layer (e.g., formed using the systems shown in FIGS. 3 and 7) or when applied over the applied deinking layer (e.g., formed using the systems shown in FIGS. 4 through 6).

Referring now to FIGS. 3 and 4 together, two examples of a liquid electrophotographic printing system 10 and 10' are depicted. The example LEP system 10 shown in FIG. 3 is used to apply a deinking solution to a substrate after an ink layer has been applied to the substrate. The example LEP system 10' shown in FIG. 4 is used to apply a deinking solution to a substrate before an ink layer has been applied to the substrate.

Each of the systems 10 and 10' includes a photoconductor 12 that is configured to rotate in a first direction (as denoted by the left pointing arrow in the photoconductor 12). The photoconductor 12 has a surface $S_{12}$ that may be exposed to various elements of the system 10 or 10' when the photoconductor 12 is rotated.

A charger unit 14 is operatively positioned adjacent to a portion of the surface $S_{12}$ of the photoconductor 12. The charger unit 14 may be a corona generator that includes a single wire or an array of wires (i.e., two or more). In an example, the charger unit 14 may be a roller based unit known as a charge roller. In wire based charging units, examples of suitable wire materials include metals, such as platinum, gold, palladium, titanium, alloys, etc. In some examples disclosed herein, the wire(s) of the charger unit 14 may be positioned parallel to the plane of the surface (e.g., $S_{12}$) to be exposed to the corona discharge. This is believed to create a relatively uniform charge distribution. The wire(s) of the charger unit 14 may also be positioned 10 mm or less from the surface $S_{12}$ to be exposed to the corona discharge. It is to be generally understood that the charger unit 14 is capable of generating a relatively high electric field, where such electric fields may be used by the digital printing system 10 or 10' for image development and formation of the ink layer. In an example, the electric charge or field of the corona discharge ranges from about 1 kV to about 5 kV when the current applied to the charger unit 14 ranges from about 1 μA to about 1000 μA. The current may be convective current, which facilitates improved mixing in the ink layer.

When the LEP system 10 or 10' is in operation, the corona discharge from charger unit 14 generates a charge on the portion of the photoconductor surface $S_{12}$ exposed to the discharge. It is to be understood that the photoconductor 12 rotates to develop a substantially uniform layer of charge on the surface $S_{12}$. The charge may be positive or negative, depending upon the type of charger unit 14 that is used.

The LEP systems 10, 10' may also include a laser writer unit 16 that is positioned adjacent to the photoconductor surface $S_{12}$. Generally, the laser writer unit 16 may be positioned such that as the photoconductor 12 rotates in the first direction, some of the areas of the surface $S_{12}$ exposed to the corona discharge from the charger unit 14 are exposed to the emission from the laser writer unit 16. The laser writer unit 16 may be selected so that its emission can generate charges opposite to those already present on the surface $S_{12}$ from within the photoconductor 12. By virtue of creating these opposite charges, the laser writer unit 16 effectively neutralizes the previously formed charges at areas exposed to the laser emission. This neutralization forms a latent image. It is to be understood that those areas of the surface $S_{it}$ not exposed to the laser writer unit 16 remain charged.

The systems 10 and 10' may further include an ink transfer unit 18 (e.g., a cartridge). As shown in FIGS. 3 and 4, multiple ink transfer units 18 may be used. As an example, four ink transfer units 18 are included to dispense four different colored inks (e.g., magenta, cyan, yellow, and black). Each of the ink transfer units 18 includes a fluid ejector or printhead (e.g., a thermal printhead or a piezoelectric printhead) that is fluidly and operatively connected to a reservoir that houses an LEP digital ink. It is to be understood that, in an example, the inks are selected to carry a charge that is opposite to that of the uniform layer of charge on the surface $S_{12}$. In an example, the ink transfer unit(s) 18 is/are operatively positioned to deposit the ink(s) onto the latent image. Charged ink(s) may be transferred from the ink transfer unit(s) 18 onto the discharged (i.e., neutralized) regions on the surface $S_{12}$ by applying an appropriate potential bias on the ink transfer unit(s) 18. In another example, the inks may be oppositely charged from the charges remaining on the surface $S_{12}$, and may be applied to the remaining charged region. In this example, the charges remaining on the surface $S_{12}$ after exposure to the laser will attract the oppositely charged ink(s).

These examples of the LEP system 10, 10' may also include an intermediate transfer medium 20 and an impression cylinder 22. The intermediate transfer medium 20 may be, for example, a dielectric drum, that is configured to rotate in a second direction (denoted by the right pointing arrow), while the impression cylinder 22 is configured to rotate in the first direction (i.e., the same direction as the photoconductor 12, denoted by the left pointing arrow) that is opposite to the rotation direction of the intermediate transfer medium 20. The three components 12, 20, 22 operate such that the ink can be transferred from the photoconductor 12 to the intermediate transfer medium 20, and from the intermediate transfer medium 20 to the substrate 24, which is guided by the impression cylinder 22.

A controller or processor (not shown) is operatively connected to each of the components of the systems 10 or 10' in order to command the respective components to operate in a desired manner. The processor is capable of running suitable computer readable code (i.e., non-transitory machine readable instructions embedded on a medium) for receiving desirable digital images, and generating commands to reproduce the digital images using the components of the systems 10, 10'.

In the example system 10 shown in FIG. 3, as the photoconductor 12 rotates, the ink is transferred from the surface $S_{12}$ of the photoconductor 12 to the surface $S_{20}$ of the intermediate transfer medium 20. The impression cylinder 22 guides the substrate 24 such that a surface of the substrate 24 contacts the ink on the rotating intermediate transfer medium 20. When in contact, the ink transfers to the substrate 24 (in the presence of an electric field).

The system 10 shown in FIG. 3 includes a post-treatment deinking applicator 26, which includes a dispenser 28 and a roller 30. In the post-treatment deinking applicator 26, the roller 30 is positioned downstream of the intermediate transfer medium 20. The positioning of the roller 30 in this example enables the deinking solution contained within the reservoir 28 to be applied to the substrate 24 after the ink has been transferred to the substrate 24.

The dispenser 28 is a dispenser that contains and deposits the deinking solution. The dispenser 28 may be similar to the ink transfer unit 18, or may be any other spraying mechanism that is capable of depositing the deinking solution onto the roller surface $S_{30}$.

The roller 30 (that rotates in the same direction as the intermediate transfer medium 20) guides the substrate 24 such that the previously applied ink is positioned to have the deinking solution applied thereto. An example of the roller 30 is a sponge roller.

The post-treatment deinking applicator 26 may be configured so that it may be selectively engaged. As such, for some print jobs, the dispenser 28 and roller 30 will not be activated and the deinking solution will not be applied. However, for other print jobs (e.g., high ink coverage print jobs or for blanket cleaner pages in LEP presses), the dispenser 28 and roller 30 will be activated and the deinking solution will be applied as described hereinbelow. The selective activation of the post-treatment deinking applicator 26 is controlled by the processor. In some instances, a user of the system 10 inputs commands, which are operable via the processor, that activate the post-treatment deinking applicator 26. In other instances, the processor may be programmed to activate the post-treatment deinking applicator 26 when blanket cleaner pages are being printed. In other examples, the processor may be programmed to activate the post-treatment deinking applicator 26 for all print jobs. A command from the processor engages the dispenser 28 to eject the solution onto the roller 30, and engages the roller 30 to the substrate path.

When the post-treatment deinking applicator 26 is activated, the dispenser 28 dispenses a predetermined amount of the deinking solution onto the roller 30. The roller rotates in the same direction as the intermediate transfer medium 20. When the substrate 24 is guided past the roller 30, the deinking solution is transferred from the roller 30 to the substrate 24 having the ink previously transferred thereto.

It is to be understood that the system 10 disclosed herein may be set up to perform duplex (i.e., two-sided) printing, where the deinking solution may be applied to both sides of a substrate 24. In this example, the system 10 includes a second post-treatment deinking applicator 26', which includes another roller 30' and another dispenser 28'. This post-treatment deinking applicator 26' operates in a similar fashion as the post-treatment deinking applicator 26 to coat the opposite side of the substrate 24.

The example system 10 shown in FIG. 3 may also include a heating mechanism (not shown). Heating mechanisms may be positioned to dry the ink after it has been applied to the substrate 24 and/or to dry the deinking solution after it has been applied to the substrate 24 having ink applied thereon. Heating may be accomplished using hot air, infrared heating, etc. Any suitable heating mechanism may be used, including a hot air dryer and/or an infrared lamp. The time for drying should be compatible with the speed of the printer, so that the printing time is not lengthened. It is to be further understood that active drying may also be eliminated at least in part because the heat generated at the intermediate transfer medium 20 may be redirected and used to dry the ink and/or deinking solution after application.

Referring now specifically to FIG. 4, in addition to the components (e.g., 12, 14, 16, 18, 20 and 22), the system 10' includes a pre-treatment deinking applicator 32, which includes a reservoir 34 and a roller 36. In the pre-treatment deinking applicator 32, the roller 36 is positioned upstream of the intermediate transfer medium 20. The positioning of the roller 36 in this example enables the deinking solution contained within the reservoir 34 to be applied to the substrate 24 before the ink has been transferred to the substrate 24.

The reservoir 34 is a dispenser that contains and deposits the deinking solution. The dispenser 34 may be similar to the ink transfer unit 18, or may be any other spraying mechanism that is capable of depositing the deinking solution onto the roller surface $S_{36}$.

The roller 36 (that rotates in the same direction as the intermediate transfer medium 20) guides the substrate 24 such that the substrate 24 is positioned to have the deinking solution applied thereto. An example of the roller 36 is a sponge roller.

The pre-treatment deinking applicator 32 may be configured so that it may be selectively engaged. As such, for some print jobs, the dispenser 34 and roller 36 will not be activated and the deinking solution will not be applied. However, for other print jobs (e.g., high ink coverage print jobs or for intermediate transfer medium cleaner pages in LEP presses), the dispenser 34 and roller 36 will be activated and the deinking solution will be applied as described hereinbelow. The selective activation of the pre-treatment deinking applicator 32 is controlled by the processor. In some instances, a user of the system 10 inputs commands, which are operable via the processor, that activate the pre-treatment deinking applicator 32. In other instances, the processor may be programmed to activate the pre-treatment deinking applicator 32 when blanket cleaner pages are being printed. In other examples, the processor may be programmed to activate the pre-treatment deinking applicator 32 for all print jobs. In any of these examples, a command from the processor engages the dispenser 34 to eject the solution onto the roller 36, and engages the roller 36 to the substrate path. This allows the roller 30 to apply the deinking solution onto the substrate 24 prior to the substrate 24 receiving ink from the intermediate transfer medium 20.

When the pre-treatment deinking applicator 32 is activated, the dispenser 34 dispenses a predetermined amount of the deinking solution onto the roller 36. The roller 36 rotates in the same direction as the intermediate transfer medium 20. When the substrate 24 is guided past the roller 36, the deinking solution is transferred from the roller 36 to the substrate 24, which has not yet had ink previously transferred thereto. After the deinking solution is transferred to the substrate 24, the coated substrate 24' is guided between the intermediate transfer medium 20 and the impression cylinder 22. The ink that has been transferred from the photoconductor 12 to the intermediate transfer medium 20 is then transferred to the coated substrate 24' as it moves between the medium 20 and the cylinder 22.

It is to be understood that the system 10' disclosed herein may be set up to perform duplex (i.e., two-sided) printing, where the deinking solution may be applied to both sides of a substrate 24. In this example, the system 10' includes a second pre-treatment deinking applicator 32', which includes another roller 36' and another dispenser 34'. This pre-treatment deinking applicator 32' operates in a similar fashion as the pre-treatment deinking applicator 32 to coat the opposite side of the substrate 24.

The example system 10' shown in FIG. 4 may also include a heating mechanism (not shown). Heating mechanisms may be positioned to dry the deinking solution after it has been applied to the substrate 24 and/or to dry the ink after it has been applied to the coated substrate 24'. In this example, it is desirable that the coated substrate 24' (including a deinking layer thereon) be substantially dry before ink is transferred thereon. A substantially dry deinking layer will prevent the deinking solution from being transferred to the printing system 10'. Heating within this system 10' may be accomplished using hot air, infrared heating, etc. Any suitable heating mechanism may be used, including a hot air dryer and/or an infrared lamp. The time for drying should be compatible with the speed of the printer, so that the printing time is not lengthened. It is to be further understood that active drying may also be eliminated at least in part because the heat generated at the intermediate transfer medium 20 may be redirected and used to dry the deinking solution and/or ink after their respective applications.

The LEP systems 10, 10' may also include a charge neutralization unit (not shown) that is positioned after the photoconductor 12 contacts the intermediate transfer medium 20 and adjacent to the surface $S_{12}$ of the photoconductor 12. The charge neutralization unit neutralizes any opposite charges remaining on the surface $S_{12}$ of the photoconductor 12 prior to the next cycle of printing.

For the LEP printing systems 10 and 10', the ink may be any suitable liquid toner and the substrate 24 may be any suitable medium capable of receiving the liquid toner. An example of the liquid toner includes HP-Indigo ElectroInk, and an example of the medium includes a coated sheet paper, such as STERLING® Ultra Digital (from Newpage Corp., Miamisburg).

Figure 7:
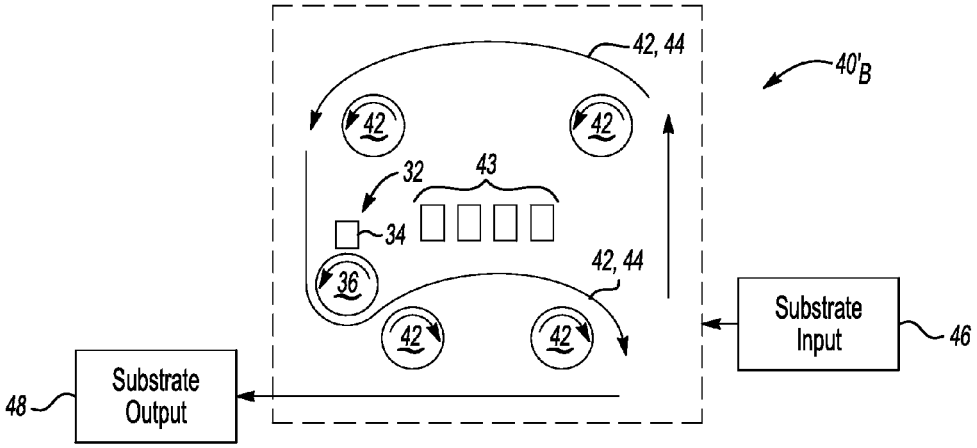
FIG. 7 is a schematic diagram of another example of an inkjet printing system including an example of a pre-treatment deinking applicator.

Referring now to FIGS. 5 through 7, examples of the inkjet printing system 40, $\mathbf{40'}_A$, and $\mathbf{40'}_B$ are depicted. Each of these systems 40, $\mathbf{40'}_A$, and $\mathbf{40'}_B$ includes a media transport device 42, a deinking applicator (either a post-treatment deinking applicator 26 or a pre-treatment deinking applicator 32), and a printhead array 43.

The media transport device 42 is a mechanism that, when in operation, transports or moves the substrate 24 relative to and between at least the deinking applicator 26 or 32 and the printhead array 43. As such, the media transport device 42 defines a substrate path 44 for the substrate 24 through the inkjet printing system 40, $\mathbf{40'}_A$, or $\mathbf{40'}_B$. The substrate path 44 may be straight, arched, or have any other desirable configuration.

The media transport device 42 includes a substrate input 46 and a substrate output 48. The input 46 receives the substrate 24 into the system 40, $\mathbf{40'}_A$, and $\mathbf{40'}_B$, the output 48 exits the substrate 24 from the system 40, $\mathbf{40'}_A$, and $\mathbf{40'}_B$, and another component of the media transport device 42 moves the substrate 24 between the input 46 and the output 48. In an example, the media transport device 42 moves the substrate 24 in the form of a web, and the input 46 and the output 48 include, respectively, supply and take up rolls. In another example, the media transport device 42 moves the substrate 24 in the form of individual sheets. It is to be understood that the media transport device 42 may include belts, conveyors (FIGS. 5 and 6), rollers (FIG. 7), or other structures to drive and move the substrate 24.

In the examples shown in FIGS. 5 and 6, a belt or conveyor moves left-to-right under the roller 30 or 36 and the printhead array 43 to transport the substrate 24 through the systems 40 and $\mathbf{40'}_A$. In the example shown in FIG. 7, a web moves right-to-left across rollers at the top of the system $\mathbf{40'}_B$ and then is fed down and left-to-right over an arched portion of the substrate path 44 under the roller 36 and the printhead array 43. Although the substrate path 44 is shown as a simple path moving from left-to-right and/or right-to-left, it is to be understood that the actual substrate transport path may contain a series of arches to provide enough time for drying of the ink as well as the deinking solution.

The deinking applicator utilized in the inkjet printing systems may be the previously described post-treatment deinking applicator 26 (as shown in FIG. 5) or the previously described pre-treatment deinking applicator 32 (as shown in FIGS. 6 and 7). In any of these examples, the pre- or post-treatment deinking applicator 32 or 26 may be configured so that it may be selectively engaged. As such, for some print jobs, the components of the pre- or post-treatment deinking applicator 32 or 26 will not be activated, and the deinking solution will not be applied. However, for other print jobs (e.g., high ink coverage print jobs), the components of the pre- or post-treatment deinking applicator 32 or 26 will be activated and the deinking solution will be applied as described hereinbelow. The selective activation of the pre- or post-treatment deinking applicator 32 or 26 is controlled by a processor. In some instances, a user of the system 40, $\mathbf{40'}_A$, or $\mathbf{40'}_B$ inputs commands, which are operable via the processor, that activate the pre- or post-treatment deinking applicator 32 or 26. In other examples, the processor may be programmed to activate the pre- or post-treatment deinking applicator 32 or 26 for all print jobs.

Each of the inkjet printing system 40, $\mathbf{40'}_A$, and $\mathbf{40'}_B$ includes the previously mentioned printhead array 43. The printhead array 43 may dispense a single inkjet ink, or multiple inkjet inks. In the examples shown in FIGS. 5 through 7, the printhead array is configured to dispense four different colored inks. The printhead array 43 includes a printbar or multiple printbars in tandem for each ink that is to be dispensed. The tandem arrangement may provide additional fault-tolerance compared to the single printbar arrangement. In an example, a single printbar includes seven printheads. The printheads may be thermal inkjet printheads or piezoelectric inkjet printheads. Each of the printheads is fluidly and operatively connected to a reservoir that houses an inkjet digital ink.

The previously mentioned controller or processor (not shown) is operatively connected to each of the components of the systems 40, $\mathbf{40'}_A$ or $\mathbf{40'}_B$ in order to command the respective components to operate in a desired manner. The processor is capable of running suitable computer readable code (i.e., non-transitory machine readable instructions embedded on a medium) for receiving desirable digital images, and generating commands to reproduce the digital images using the components of the systems 40, $\mathbf{40'}_A$ or $\mathbf{40'}_B$.

In the example system 40 shown in FIG. 5, the media transport device 42 is configured to first transport the substrate 24 such that the substrate 24 is positioned adjacent to the printhead array 43. The printhead array 43 may then be activated to dispense ink(s) to form a desirable image on the substrate 24.

Once ink is applied to the substrate 24, the media transport device 42 then moves the substrate 24 from the printhead array 43 to the post-treatment deinking applicator 26. The post-treatment deinking applicator 26 is positioned downstream of the printhead array 43. The positioning of the post-treatment deinking applicator 26 in this example enables the inkjet deinking solution contained within the dispenser 28 to be applied to roller 30 and then transferred to the substrate 24 after the ink has been dispensed directly on the substrate 24. The dispenser 28 and roller 30 used in this example have been described herein in reference to FIG. 3. In the system 40, the dispenser 28 may include an inkjet printhead or any other spraying mechanism that is capable of depositing the inkjet deinking solution onto the roller surface $S_{30}$. The roller 30 may be a sponge roller that rotates to contact the guided substrate 24 such that the previously applied ink is positioned to have the inkjet deinking solution applied thereto. Since the post-treatment deinking applicator 26 is in-line with ink application, the application of the deinking solution is within second(s) or fraction(s) of a second of the ink application.

The example system 40 shown in FIG. 5 may also include a heating mechanism (not shown). Heating mechanisms may be positioned to dry the ink after it has been applied to the substrate 24 and/or to dry the deinking solution after it has been applied to the substrate 24 having ink applied thereon. Heating may be accomplished using any suitable heating mechanism previously described herein. The time for drying should be compatible with the speed of the printer, so that the printing time is not lengthened.

Referring now to FIGS. 6 and 7, the media transport device 42 is configured to first transport the substrate 24 such that the substrate 24 contacts the roller 36 of the pre-treatment deinking applicator 32. The pre-treatment deinking applicator 32 is positioned upstream of the printhead array 43. The positioning of the pre-treatment deinking applicator 32 in these examples enables the inkjet deinking solution contained within the dispenser 34 to be applied to the roller 36 and then transferred to the substrate 24 before ink is dispensed from the printhead array 43. The dispenser 34 and roller 36 used in this example have been described herein in reference to FIG. 4. In the systems 40'$_A$ and 40'$_B$, the dispenser 34 may include an inkjet printhead or any other spraying mechanism that is capable of depositing the inkjet deinking solution onto the roller surface $S_{36}$. The roller 36 may be a sponge roller that rotates to contact the guided substrate 24 such that the substrate surface is positioned to have the inkjet deinking solution applied thereto.

Once the inkjet deinking solution is applied to the substrate 24, the media transport device 42 then moves the substrate 24 from the pre-treatment deinking applicator 32 to the printhead array 43.

The example system 40 shown in FIGS. 6 and 7 may also include a heating mechanism (not shown). Heating mechanisms may be positioned to dry the inkjet deinking solution after it has been applied to the substrate 24 and/or to dry the ink after it has been applied to the previously coated substrate. Heating may be accomplished using any suitable heating mechanism previously described herein. The time for drying should be compatible with the speed of the printer, so that the printing time is not lengthened.

In the examples shown in FIGS. 6 and 7, since the printhead array 43 is in-line with the pre-treatment deinking applicator 32, the application of the ink may be within second(s) or fraction(s) of a second of the inkjet deinking solution application, so long as the inkjet deinking solution is substantially dry. By substantially dry, it is meant that the substrate 24 is ready for the next operation in the printing system, and that the next operation may be performed without any deleterious effect to the substrate 24 or any substance that has been applied thereto.

When duplex printing is desired with inkjet printing systems 40, 40'$_A$, and 40'$_B$, two of the systems 40, 40'$_A$, and 40'$_B$ may be used. A turn bar may be used between the systems 40, 40'$_A$, and 40'$_B$ to flip the substrate 24 over between the systems 40, 40'$_A$, and 40'$_B$.

For the inkjet printing systems 40, 40'$_A$, and 40'$_B$, the ink may be any suitable inkjet ink and the substrate 24 may be any suitable medium capable of receiving the inkjet ink. In an example, the substrate 24 may be a porous medium, which has an overly porous structure that can absorb the majority of an applied ink and inkjet deinking solution. In some examples, the porous medium encompasses a high volume of voids and has a high liquid-absorbing capacity. One example of porous media is paper. The porosity may be attributed to the porosity of the coating structure deposited onto a base substrate or from the base substrate itself. The porosity of the medium 24 may be represented by air permeance, in the range of from 15 to 40 Sheffield unit Parker Print-Surf testers.

Fibers of the substrates disclosed herein that include ink and the deinking solution (either LEP or inkjet) applied thereon may be recycled using a conventional paper recycling process. For example, the printed-on substrates may be placed inside a recycling mill, and then the colorant of the ink that was deposited on the substrate may be detached from the fibers of the substrate 24 to form a deinked pulp. The detaching of the colorant from the substrate 24 may be referred to herein as a deinking process. This deinking process includes pulping the printed-on substrate in the presence of a deinking liquid to form a slurry. Pulping may be accomplished by introducing the printed-on substrate into a pulper of the recycling mill, and then chopping the printed medium up into smaller pieces. In a neutral or near-neutral deinking process, pulping takes place in the presence of neutral or near-neutral deinking chemicals (e.g., those chemicals having a pH within the range of about 7 to about 8). In an alkaline-based deinking process, pulping takes place in the presence of alkaline-based deinking chemicals, such as NaOH (an alkalinity modifier), a $Na_2SiO_3$ solution (an alkalinity buffering agent), oleic acid or another suitable acid, and $H_2O_2$ (a bleaching agent). It is believed that some deinking chemicals (e.g., oleic acid) may not be utilized during pulping due, at least in part, to the required specifications (e.g., as dictated by the deinking method used) of the recovered pulps for certain final paper products (e.g., tissue paper). It is to be understood that during either the neutral/near-neutral deinking process or the alkaline-based deinking process, water may be added inside the pulper while the printed medium is chopped, thereby converting the printed medium into a slurry of pulp and ink.

During the pulping process, the deinking agent in and/or on the printed-on substrate interacts with the ink that was printed on the substrate. During this interaction, the ink breaks into smaller particles that are removable during a flotation process, described below. The inks that may be removed from a printed-on substrate via the deinking process described herein include LEP inks, pigment-based inkjet inks, and dye-based inkjet inks.

Regardless of the deinking process used to make the slurry, upon making the slurry, examples of the method include performing a flotation process. The flotation process is used to separate the ink from the slurry.

When a neutral or near-neutral deinking process is used, the slurry is introduced into a froth flotation cell, and then a collector (e.g., a frother) is introduced into the slurry. One example of a suitable frother is sodium dodecyl sulfate. The frother facilitates formation of foam which allows the removal of the detached ink particles from the fibers. More particularly, since the frother has an affinity to the now-detached colorant particles, the colorant particles attach to the frother foam. The foam has a sufficient yield strength to carry a large distribution of colorant particles to the top of the froth flotation cell. In an example, air may also be blown into the slurry. The air bubbles lift the colorant particles to the surface of the flotation cell as a thick froth, which may be removed from the cell.

When an alkaline-based deinking process is used, the slurry is introduced into a froth flotation cell. The flotation process of this example may take place in the presence or the absence of a frother.

In some instances, the pulp slurry is screened to remove any materials that may be denser than the pulp, such as contaminants or other foreign matter. In an example, coarse and fine screening may be accomplished, for example, by passing the slurry over or through a screen with varying slot opening sizes to separate such materials from the slurry, and these materials may be caught using another mesh screen.

To further illustrate the present disclosure, examples are given herein. It is to be understood that these examples are provided for illustrative purposes and are not to be construed as limiting the scope of the present disclosure.

EXAMPLE

An example of the LEP deinking solution was prepared using ISOPAR® L and MYRJ® 45. The LEP deinking solution was either a 0.05%-0.2% solution of the MYRJ® 45 in the ISOPAR® L or a 2% solution of the MYRJ® 45 in the ISOPAR® L. Double sided photo prints were generated using an HP Indigo 7000 digital press. In particular, ELECTROINK® 4.5 was printed on both sides of M-Real Silver Digital Gloss paper (130 gsm). Ink coverage was greater than 600% coverage for each print. After the images were printed, the deinking solution was coated on the imaged sides of the paper via a sponge roller. The thickness of the resulting LEP deinking layer was about 50 nm. After the deinking solution was applied, there was no noticeable paper distortion. After the deinking solution was applied, the samples were dried.

For comparative examples, the deinking solution was not applied after the ELECTROINK® was printed on M-Real Silver Digital Gloss paper.

An alkaline-based deinking evaluation was performed for the coated LEP print media samples and the comparative uncoated LEP print media samples. The alkaline-based deinking followed the protocol as outlined in INGEDE (International Association of the Deinking Industry) Method 11p. The first step of the alkaline-based deinking process involved pulping some of the printed papers in the presence of 0.3% NaOH, 0.9% $Na_2SiO_3$ solution (1.3 g/L-1.4 g/L), and 0.8% Oleic Acid (no hydrogen peroxide was used). Pulping with 15% consistency at 45° C. occurred for about 20 minutes. This was then followed by a flotation process (about 0.8% consistency, 45° C., from about 10 minutes to about 30 minutes) in a flotation cell.

Pulp samples were retrieved throughout the process, and respective handsheets were made from all of the pulps (those obtained before and after flotation) to evaluate the efficiency of the deinking processes when the deinking solution was applied in-line with printing via a sponge roller. The sample pulps obtained before flotation are referred to herein as undeinked samples and the sample pulps obtained after flotation are referred to herein as deinked samples.

Figure 8A:
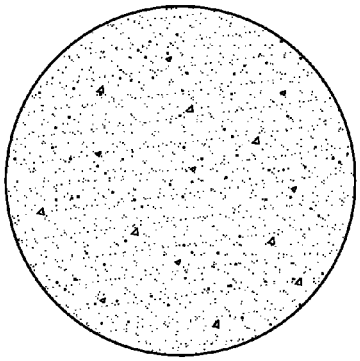
FIGS. 8A and 8B are schematic representations of handsheets made from non-deinked pulps (FIG. 8A) and deinked pulps (FIG. 8B), where the pulps are from uncoated LEP print media.
Figure 9A:
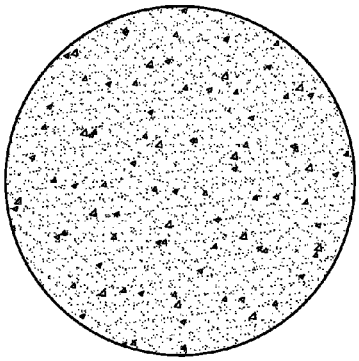
FIGS. 9A and 9B are schematic representations of handsheets made from non-deinked pulps (FIG. 9A) and deinked pulps (FIG. 9B), where the pulps are from LEP print media having an example deinking solution applied thereon.
Figure 8B:
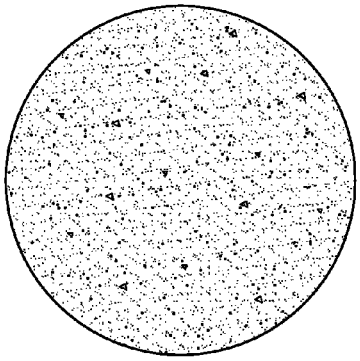
Figure 9B:
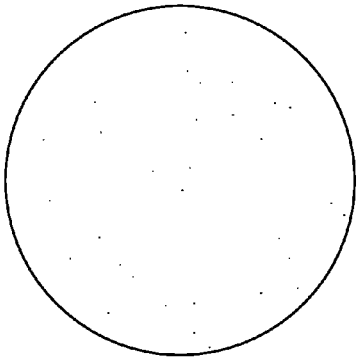

FIGS. 8A, 8B, 9A and 9B show schematic view of the handsheets made from the undeinked pulps (i.e., those that did not undergo flotation) and deinked pulps of the uncoated LEP print media samples (FIGS. 8A and 8B) and the LEP print media samples coated with the deinking solution including 0.1-0.2% MYRJ® 45 in the ISOPAR® L (FIGS. 9A and 9B). More particularly, FIGS. 8A and 8B show schematic illustrations of the handsheets made, respectively, from the undeinked (i.e., non-deinked) and deinked pulps of the uncoated LEP print media samples that were obtained via the alkaline-based process; and FIGS. 9A and 9B show schematic illustrations of the handsheets made, respectively, from the undeinked (i.e., non-deinked) and deinked pulps of the LEP print media samples coated with the deinking solution including 0.05-0.2% MYRJ® 45 in the ISOPAR® L that were obtained via the alkaline-based process. As illustrated in FIG. 9B, the handsheets made from deinked pulp obtained for the LEP samples coated with the deinking solution (including 0.05-0.2% MYRJ® 45 in the ISOPAR® L) were relatively free of ink specks. This is in sharp contrast to the handsheets shown in FIG. 8B, which were made from deinked pulp obtained for the uncoated LEP print media samples. The comparative uncoated LEP print media samples (FIGS. 8A and 8B) were considered undeinkable.

Table 1 shows the results for the deinked uncoated and coated LEP samples. The first section of Table 1 illustrates the European Recycling Paper Council's deinking score card parameters; the second and third sections of Table 1 illustrate the scores for the differently coated LEP samples; and the fourth section of Table 1 illustrates the Dirt scores for the uncoated LEP samples.

TABLE 1

| | Optical Brightness, Y | Color Shade, a* | Dirt, $A_{50}$ ($mm^2/m^2$) | Dirt, $A_{250}$ ($mm^2/m^2$) | Ink Elimination, IE (%) | Filtrate Darkening, ΔY | Total Score |
|---|---|---|---|---|---|---|---|
| European Recycling Paper Council Deinking Scorecard's Parameters | | | | | | | |
| Threshold | 47 | −3/+2 | 2000 | 600 | 40 | 18 | 100 |
| Target | 90 | −2/+1 | 600 | 180 | 80 | 6 | |
| Max | 35 | 20 | 15 | 10 | 10 | 10 | |
| Score | | | | | | | |
| Coated LEP Samples w/ 2% MYRJ ® 45 in the ISOPAR ® L (30 min. flotation) | | | | | | | |
| Result | 87.2 | −1.1 | 508 | 106 | 93.3 | 4.4 | 97 |
| Score | 32 | 20 | 15 | 10 | 10 | 10 | |
| Coated LEP Samples w/ 0.05-0.2% MYRJ ® 45 in the ISOPAR ® L (12 min. flotation) | | | | | | | |
| Result | 83.3 | −0.7 | 444 | 355 | 89.9 | 1.5 | 88 |
| Score | 27 | 20 | 15 | 6 | 10 | 10 | |
| Comparative Uncoated LEP Samples | | | | | | | |
| Result | — | — | 15900 | 117000 | — | — | negative |
| Score | — | — | negative | negative | — | — | |

It is to be understood that a total score of 70 on the European Recycling Paper Council's deinking score card is considered to be good deinkability.

The results obtained for the comparative uncoated LEP samples illustrate the poor deinkability of LEP images when the post-treatment composition disclosed herein is not used. While the optical brightness, color shade, ink elimination, and filtrate darkening results were acceptable (results not reported here), the dirt particle results were negative. This is indicative of undesirable ink speck sizes (see also FIGS. 8A and 8B), and thus the overall score for the comparative uncoated LEP sample was negative.

In contrast, the results obtained for both of the coated LEP samples illustrated that the coating facilitated good deinkability of LEP inks from the high ink coverage media. The optical brightness (luminosity) of each of the coated LEP print media samples was close to the target level (for high-grade writing paper) of 90%. The filtrate darkening (i.e., an indication of the discoloration of the deinking process water) was 4.4 and 1.5, respectively, which were noticeably better than the target level of 6. The color shade was also well within the target range for each of the samples. The dirt particle results were almost all below the target level, which is desirable. Overall, the results illustrate that the coating renders the media deinkable and effectively enhances deinking.

It is to be understood that the ranges provided herein include the stated range and any value or sub-range within the stated range. For example, a range from about 10 nm to about 500 nm should be interpreted to include not only the explicitly recited limits of about 10 nm to about 500 nm, but also to include individual values, such as 85 nm, 352 nm, 400 nm, etc., and sub-ranges, such as from about 75 nm to about 450 nm, from about 250 nm to about 300 nm, etc. Furthermore, when "about" is utilized to describe a value, this is meant to encompass minor variations (up to +/− 10%) from the stated value.

In describing and claiming the examples disclosed herein, the singular forms "a", "an", and "the" include plural referents unless the context clearly dictates otherwise.

While several examples have been described in detail, it will be apparent to those skilled in the art that the disclosed examples may be modified. Therefore, the foregoing description is to be considered non-limiting.

What is claimed is:

1. A digital printing system comprising:

components to apply an ink layer on a substrate; and a deinking applicator, including:

a reservoir to contain a deinking solution; and a roller positioned to receive the deinking solution from the reservoir and to coat the substrate with the deinking solution prior to the application of the ink layer or subsequent to the application of the ink layer, wherein the roller is a sponge roller.

2. The digital printing system as defined in claim 1, wherein the system is a liquid electrophotographic printing system and the components include:

a photoconductor to rotate in a first direction;

a charger unit positioned to form a uniform layer of charge on a surface of the photoconductor;

a laser positioned to neutralize a portion of the uniform layer of charge to form a latent image;

an ink transfer unit positioned to eject an ink composition on the latent image to form the ink layer on the photoconductor surface;

an intermediate transfer medium to rotate in a second direction to receive the ink layer from the photoconductor surface; and an impression cylinder to rotate in the first direction to guide the substrate to receive the ink layer from the intermediate transfer medium.

3. The digital printing system as defined in claim 2, wherein:

the roller is i) positioned upstream of the intermediate transfer medium to coat the substrate with the deinking solution prior to the substrate receiving the ink layer from the intermediate transfer medium, and ii) to rotate in the second direction; and an other reservoir to contain the deinking solution; and an other roller to rotate in the first direction, the other roller positioned i) to receive the deinking solution from the other reservoir ii) upstream of the intermediate transfer medium to coat the deinking solution on a side of the substrate opposed to a side that is to receive the ink layer from the intermediate transfer medium.

4. The digital printing system as defined in claim 2, wherein:

the roller is i) positioned downstream of the intermediate transfer medium to coat the substrate with the deinking solution subsequent to the substrate receiving the ink layer from the intermediate transfer medium, and ii) to rotate in the second direction; and the deinking applicator further includes:

an other reservoir to contain the deinking solution; and an other roller to rotate in the first direction, the other roller positioned i) to receive the deinking solution from the other reservoir, and ii) downstream of the intermediate transfer medium to coat the deinking solution on a side of the substrate opposed to a side that has received the ink layer.

5. The digital printing system as defined in claim 1, wherein:

the roller is positioned upstream of the intermediate transfer medium to coat the substrate with the deinking solution prior to the substrate receiving the ink layer from the intermediate transfer medium; or the roller is positioned downstream of the intermediate transfer medium to coat the substrate with the deinking solution subsequent to the substrate receiving the ink layer from the intermediate transfer medium.

6. The digital printing system as defined in claim 1, wherein the system is an inkjet printing system and the components include:

a media transport device; and a printhead array positioned a controlled distance from the media transport device to dispense an ink composition on the substrate as the substrate is moved along a substrate path of the media transport device to form the ink layer.

7. The digital printing system as defined in claim 6, wherein the roller is positioned upstream of the printhead array to coat the substrate with the deinking solution prior to the dispensing of the ink composition from the printhead array.

8. The digital printing system as defined in claim 6, wherein the roller is positioned downstream of the printhead array to coat the substrate with the deinking solution subsequent to the dispensing of the ink composition from the printhead array.

9. The digital printing system as defined in claim 1, wherein the deinking applicator is selectively engageable.

10. A digital printing system comprising:

components to apply an ink later on a substrate;

a reservoir containing a deinking solution;

a deinking applicator positioned to receive the deinking solution from the reservoir, the deinking applicator to coat the substrate with the deinking solution prior to the application of the ink layer or subsequent to the application of the ink layer, wherein the deinking solution includes:

a deinking agent incorporated into i) a non-polar carrier fluid or ii) a liquid, the deinking agent being chosen from:

an unsaturated fatty acid having from 19 to 23 carbon atoms;

combinations of unsaturated fatty acids having from 19 to 23 carbon atoms;

polyoxyethylene (12) isooctylphenyl ether;

polyoxyethylene (12) nonlyphenyl ether;

polyoxyethylene (2) cetyl ether;

polyoxyethylene (10) oleoyl ether;

polyoxyethylene (20) oleyl ether;

polyoxyethylene (100) stearyl ether;

poly(ethylene glycol) dodecyl ether;

poly(ethylene glycol) (150) distearate;

poly(ethylene glycol) (12) tridecyl ether;

poly(ethylene glycol) (18) tridecyl ether;

methoxy poly(ethylene glycol) 350;

polyethylene-block-poly(ethylene glycol) with a number average molecular weight ranging from 500 to 2500;

a monostearate having a formula $CH_3(CH_2)_{16}COO(CH_2CH_2O)_nH$, wherein n=1–16;

a monopalmitate having a formula $CH_3(CH_2)_{14}COO(CH_2CH_2O)_nH$, wherein n=2–17;

a distearate having a formula $CH_3(CH_2)_{16}COO(CH_2CH_2O)_nOC(CH_2)_{16}CH_3$, wherein n=5–13;

a dipalmitate having a formula $CH_3(CH_2)_{14}COO(CH_2CH_2O)_nOC(CH_2)_{14}CH_3$, wherein n=2–13;

a mixed diester having a formula $CH_3(CH_2)_{14}COO(CH_2CH_2O)_nOC(CH_2)_{16}CH_3$, wherein n=2–14; and combinations thereof.

11. The digital printing system as defined in claim 10, wherein the deinking applicator is selectively engageable.

12. The digital printing system as defined in claim 10, wherein the deinking applicator includes a roller positioned:

upstream of an intermediate transfer medium to coat the substrate with the deinking solution prior to the substrate receiving the ink layer from the intermediate transfer medium; or downstream of the intermediate transfer medium to coat the substrate with the deinking solution subsequent to the substrate receiving the ink layer from the intermediate transfer medium.

13. The digital printing system as defined in claim 10, wherein the digital printing system is an inkjet printing system and the components include:

a media transport device; and a printhead array positioned a controlled distance from the media transport device to dispense an ink composition on the substrate as the substrate is moved along a substrate path of the media transport device to form the ink layer.

14. The digital printing system as defined in claim 10, wherein the deinking applicator includes a roller positioned:

upstream of the printhead array to coat the substrate with the deinking solution prior to the dispensing of the ink composition from the printhead array; or downstream of the printhead array to coat the substrate with the deinking solution subsequent to the dispensing of the ink composition from the printhead array.

15. A method for generating a deinkable print, the method comprising:

applying an ink composition to a substrate; and in-line with the applying of the ink composition, selectively engaging a deinking applicator to apply a deinking solution on the substrate prior to applying the ink composition or subsequent to applying the ink composition.

16. The method as defined in claim 15, wherein the applying of the ink composition is accomplished via liquid electrophotographic printing or inkjet printing.

17. The method as defined in claim 15, wherein the deinking applicator comprises:

a reservoir containing the deinking solution; and a roller positioned to receive the deinking solution from the reservoir and to coat the substrate with the deinking solution prior to the applying of the ink composition or subsequent to the applying of the ink composition.

18. The method as defined in claim 17, wherein the selectively engaging the deinking applicator further comprises:

activating the deinking applicator via a processor in response to an input command.

19. The method as defined in claim 15, wherein the selectively engaging a deinking applicator to apply the deinking solution on the substrate occurs prior to applying the ink composition and wherein the method further comprises drying the deinking solution prior to applying the ink composition.

20. The method as defined in claim 15, wherein the selectively engaging the deinking applicator is controlled by a processor of a printing system.

* * * * *